United States Patent [19]

Dolan

[11] Patent Number: 5,018,512

[45] Date of Patent: May 28, 1991

[54] LUMBAR TRACTION DEVICE

[76] Inventor: Henry J. Dolan, 8221 SE. Groce Rd., Corbett, Oreg. 97019

[21] Appl. No.: 397,576

[22] Filed: Aug. 23, 1989

[51] Int. Cl.[5] ..... A61H 1/02

[52] U.S. Cl. ..... 128/75; 128/69; 128/68; 272/63

[58] Field of Search ..... 128/75, 68, 69, 70, 128/71, 72, 73, 74; 272/63

[56] References Cited

U.S. PATENT DOCUMENTS

| | | | |
|---|---|---|---|
| 3,353,532 | 11/1967 | Ellis | 128/75 |
| 3,859,990 | 1/1975 | Simon | 128/75 X |
| 3,896,798 | 7/1975 | Simon | 128/75 |
| 4,372,552 | 2/1983 | Carlmark | 128/75 X |
| 4,569,340 | 2/1986 | Burton | 128/75 |
| 4,735,196 | 4/1988 | Krag | 128/75 |

*Primary Examiner*—V. Millin
*Assistant Examiner*—Philip H. Kubel
*Attorney, Agent, or Firm*—Klarquist, Sparkman, Campbell, Leigh & Whinston

[57] ABSTRACT

A lumbar traction device includes pivotal load bearing elements which receive the weight of the person by way of the person's forearms and torso to support the person in an upright traction position with the arms adjacent the person's torso and bent naturally forward. The traction device restricts outward lateral movement of the person's arms to comfortably support the person without requiring the person to exert effort to maintain the traction position.

15 Claims, 2 Drawing Sheets

LUMBAR TRACTION DEVICE

BACKGROUND OF THE INVENTION

The present invention relates generally to traction devices and particularly to a lumbar traction device.

Apparatus for applying traction to the spine of a human frame has involved the use of belts or similar attachments to the body which are connected by cords and pulleys to a weight. The person's frame is literally stretched to apply traction. Such traction devices are both discomforting and potentially injurious to the person undergoing traction therapy.

As an alternative to stretching the human frame, inversion traction has been proposed. According to the method of inversion traction, the person is suspended by the feet or ankles in an inverted position. Unfortunately, hanging in an inverted position is uncomfortable and may cause distraction of the ankle and knee joints. Furthermore, stroke victims and persons having high blood pressure are unable to use inversion traction.

Therapeutic traction apparatus have been proposed which avoid stretching of the human frame by means of cords and pulleys, or inverting and hanging the person by the ankles. Such therapeutic traction apparatus generally support an upper portion of the person's body and permit the person's body weight to apply traction to the spine.

U.S. Pat. Nos. 3,896,798 and 3,859,990, issued to Simon, illustrate such therapeutic traction apparatus. The traction apparatus disclosed by Simon include parallel spaced bars each having a padded section for receiving the underarms of a person. The person is positioned between the bars and supported from below by resting his or her arms against the padded sections of the bars. By hanging from the bars in this manner, traction is applied to the spine of the person. One disadvantage of the traction apparatus shown by Simon is that the person must exert some effort in maintaining the traction position. A second disadvantage of the Simon apparatus is that blood flow through the arms is blocked because the weight of the person is carried by the undersides of the arms. As a result, extended use of the device is prohibitive, due to the amount of energy required to maintain the traction position and the blockage of blood flow through the arms.

U.S. Pat. No. 3,353,532, issued to Ellis, also discloses a traction apparatus. In the traction apparatus shown by Ellis, an open framework supports a pair of pivotally mounted support arms. At the end of each support arm is a padded member which bears against the torso of the person undergoing traction therapy. The user positions himself or herself between the padded members and brings his or her weight downward. The support arms pivot downward and draw the padded members closer together to capture the torso between the padded members. A significant disadvantage of the Ellis device is that a large amount of discomforting pressure is applied to the torso of the person. This pressure against the torso restricts breathing and increases the discomfort. A second disadvantage of the Ellis apparatus is that the padded members tend to slip upward and bear against the person's underarms, thereby further discomforting the person.

In light of the foregoing disadvantages, a lumbar traction device should provide spinal traction therapy without requiring the person to exert effort to maintain the traction position. A lumbar traction device should also comfortably support the person in an upright position and without the use of mechanical stretching means.

SUMMARY OF THE INVENTION

In a preferred embodiment of the present invention, a lumbar traction device supports the weight of a person in a natural upright traction position. The lumbar traction device includes pivotally mounted load bearing elements for receiving the right and left arms of the person and supporting at least a substantial portion of the weight of the person by way of such arms. The remaining weight of the person is supported by portions of the load bearing elements contacting the person's torso. The load bearing elements conform in shape to the arms and torso of the person and restrict outward lateral movement of the arms relative to the torso. The traction device also includes a frame structure for pivotally and adjustably supporting the load bearing elements in both traction and release positions relative to the user.

The device may include stops associated with the frame structure for determining the limits of the traction and release positions of the pivoted load-supporting elements.

The device may also include, in conjunction with the frame structure, retractable foot rests to facilitate the user's assumption of and withdrawal from a traction position in the device.

The load bearing elements may be custom molded for a particular user.

The subject matter of the present invention is particularly pointed out and distinctly claimed in the concluding portion of this specification. Both the organization and method of operation of the invention, together with further advantages and objects thereof, however, may best be understood by reference to the following description and accompanying drawings wherein like reference characters refer to like elements.

DETAILED DESCRIPTION

Figure 1:
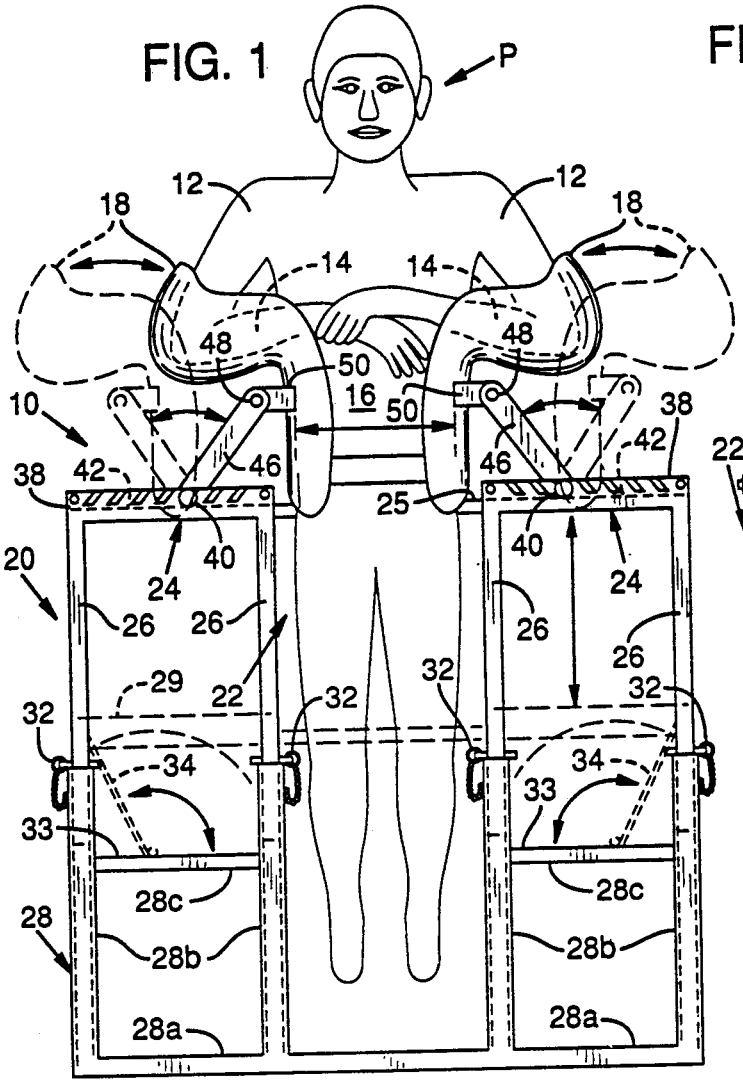
FIG. 1 is a front view of a lumbar traction device according to a preferred embodiment of the present invention.
Figure 2:
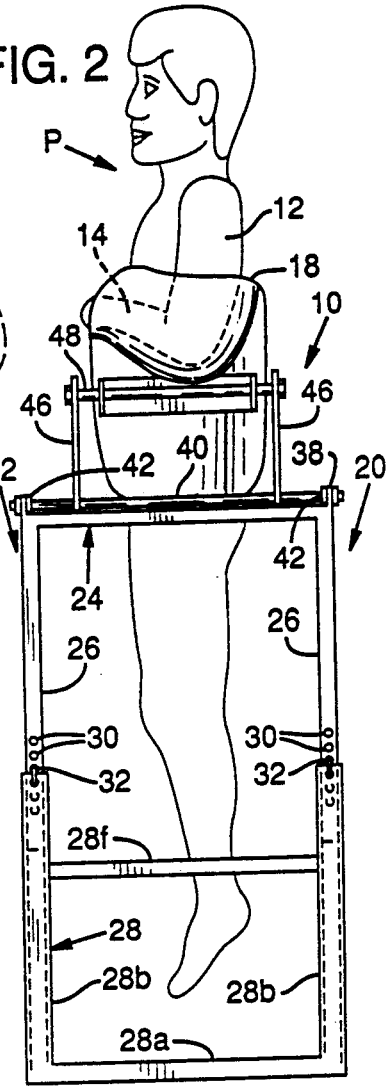
FIG. 2 is a side view of the lumbar traction device of FIG. 1.

FIGS. 1 and 2 illustrate a lumbar traction device 10 in accordance with the present invention. Lumbar traction device 10 supports a person P in an upright traction position for application of therapeutic traction. Person P has right and left upper arms 12 and right and left forearms 14. The upright traction position of person P includes positioning right and left upper arms 12 generally alongside torso 16 with right and left forearms 14 bent naturally forward at an acute angle relative to right and left upper arms 12, respectively.

As used herein, reference to structural elements of lumbar traction device 10 as being right, left, forward or rear will be with reference to the orientation of person P as shown in FIGS. 1 and 2.

Lumbar traction device 10 includes pivotally mounted load bearing elements 18 for receiving the right and left arms of person P and contacting the right and left sides of the torso 16. Elements 18 are formed as padded shells conforming in shape to the arms and torso of person P when in the upright traction position for closely receiving and supporting the person P. Load bearing elements 18 support a substantial portion of the weight of the person by way of the right and left arms. Load bearing elements 18 carry the remaining weight of person P by contact with the torso 16. The weight of person P below the level of traction is thereby applied to the spine of person P for traction therapy.

Load bearing elements 18 restrict outward lateral movement of the right and left arms of person P, and thereby enable person P to maintain the upright traction position with little effort. Person P may remain comfortably supported in the upright traction position for an extended period of traction therapy.

Figure 5:
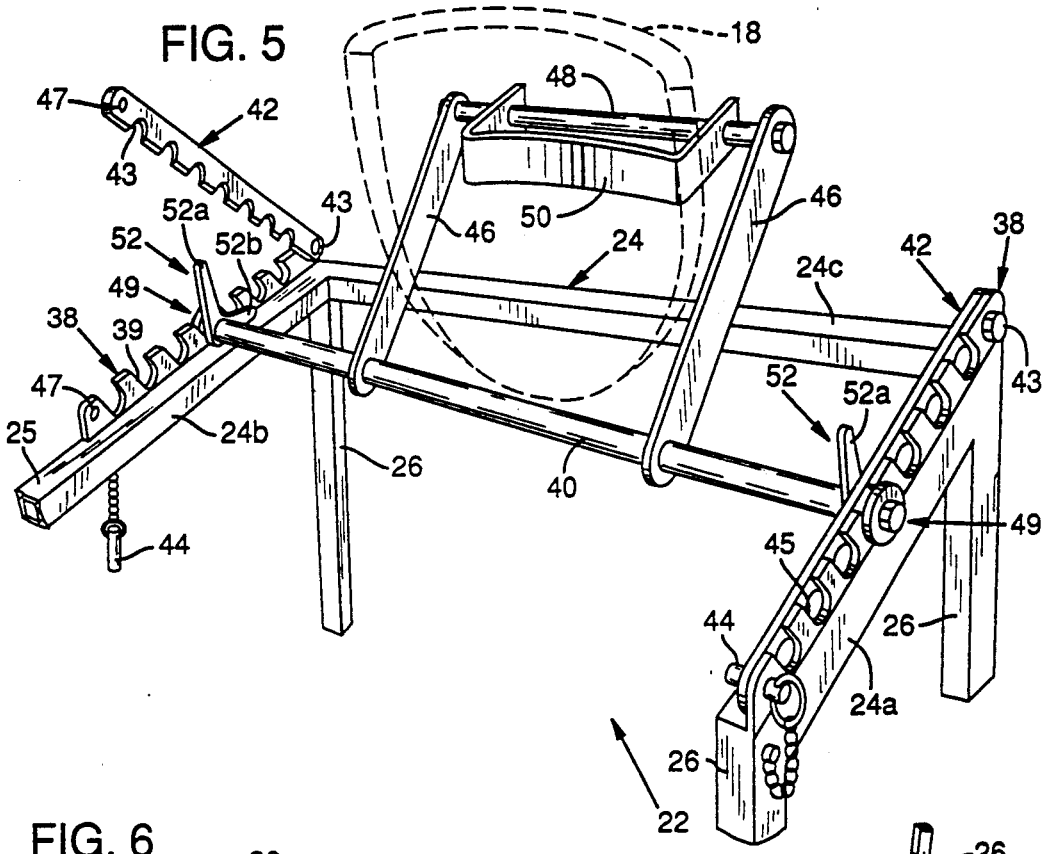
FIG. 5 is a partial perspective view of the device of FIG. 1 illustrating a pivotal support structure for the load bearing element of FIG. 3.

A freestanding open frame 20 supports the load bearing elements 18 and includes a central opening 22 for receiving the person when in the upright traction position. As best seen in FIG. 5, frame 20 includes right and left horizontal upper frames 24, each positioned on respective sides of opening 22. Each of upper frames 24 includes a forward rail **24*a* extending outward relative to opening 22, a rear rail 24*b* extending outward relative to opening 22, and an outer rail 24*c* most distant from opening 22. A horizontal interconnect rail 25 (FIGS. 1 and 5) joins the rear rails 24*b* of each of frames 24. As seen in FIG. 1 interconnect rail 25 is behind person P, and in FIG. 5 a portion of rail 25 is shown. Thus, interconnect rail 25 and rear rails 24*b* of frames 24 may be a single rail element defining the rear of opening 22 and stabilizing right frame 24 with respect to left frame 24**.

Each of upper frames 24 is supported by three vertical legs 26. Legs 26 are fixed to and extend downwardly from corresponding corners of frames 24. More particularly, one of legs 26 extends from each outer corner and from the inner forward corner of respective frames 24.

A base 28 of frame 20 includes a rectangular floor contacting structure **28*a* (FIGS. 1, 2 and 6) and six upwardly extending tubular uprights 28*b*. Each of tubular uprights 28*b* telescopically receives a corresponding one of legs 26 for vertical positioning of upper frames 24. Vertical positioning of upper frames 24 enables lumbar traction device 10** to accommodate persons of different height.

Each of legs 26 includes a series of apertures 30, and a corresponding retention pin 32 attaches nearby to base 28. Upper frame 24 is positioned by inserting legs 26 within uprights **28*b* of base 28, positioning upper frame 24 in the desired vertical position, and inserting pins 32 through the lowermost exposed apertures 30, thereby causing pins 32 to abut the upper ends of uprights 28*b* to retain legs 26 in their adjusted positions. As shown, legs 26 should be adjusted so that the feet of person P do not touch the ground when the person's arms are supported by load bearing elements 18. Phantom lines 29 in FIG. 1 show upper frames 24** in a lowermost position.

Base 28 includes horizontal right and left forward cross support rails **28*c* affixed to the corresponding forward uprights 28*b* on the right and left sides of central opening 22, and positioned one and one half to two feet above floor contacting structure 28*a*. Right and left uprights 28*d* (FIG. 6), positioned directly below the inner rear corners of upper frames 24 and extending upwardly slightly above forward cross support rails 28*c*, are affixed to base 28. Horizontal right and left rear cross support rails 28*e* are affixed to corresponding uprights 28*d* and 28*b* on respective sides of central opening 22. Right and left hinge support rails 28*f* of base 28 are affixed to forward cross support rails 28*c* and rear cross support rails 28*e* on respective sides of central opening 22. Hinge support rails 28*e* are spaced outwardly, relative to central opening 22, from inner uprights 28*b* and uprights 28*d*** by approximately one foot.

Base 28 carries a plate-like stationary foot support 33 and a plate-like hinged foot support 34 (FIGS. 1 and 6) on each side of central opening 22. Right and left stationary supports 33 extend through an area defined by rail **28*f* and outer uprights 28*b* on respective sides of central opening 22. Stationary supports 33 are affixed to base 28. Each of right and left hinged supports 34 is attached to a corresponding one of rails 28*f* by a piano hinge 36. Hinges 36 lie on the outer edges of supports 34, i.e., the edge most distant from central opening 22. Foot supports 34 thereby pivot on hinges 36 upward and away from the central opening 22. Foot supports 33 and 34 provide a platform for person P to stand upon while mounting lumbar traction device 10. Pivoting foot supports 34 up and away from central opening 22** gives person P additional space for exercise while supported in the upright traction position.

Figure 6:
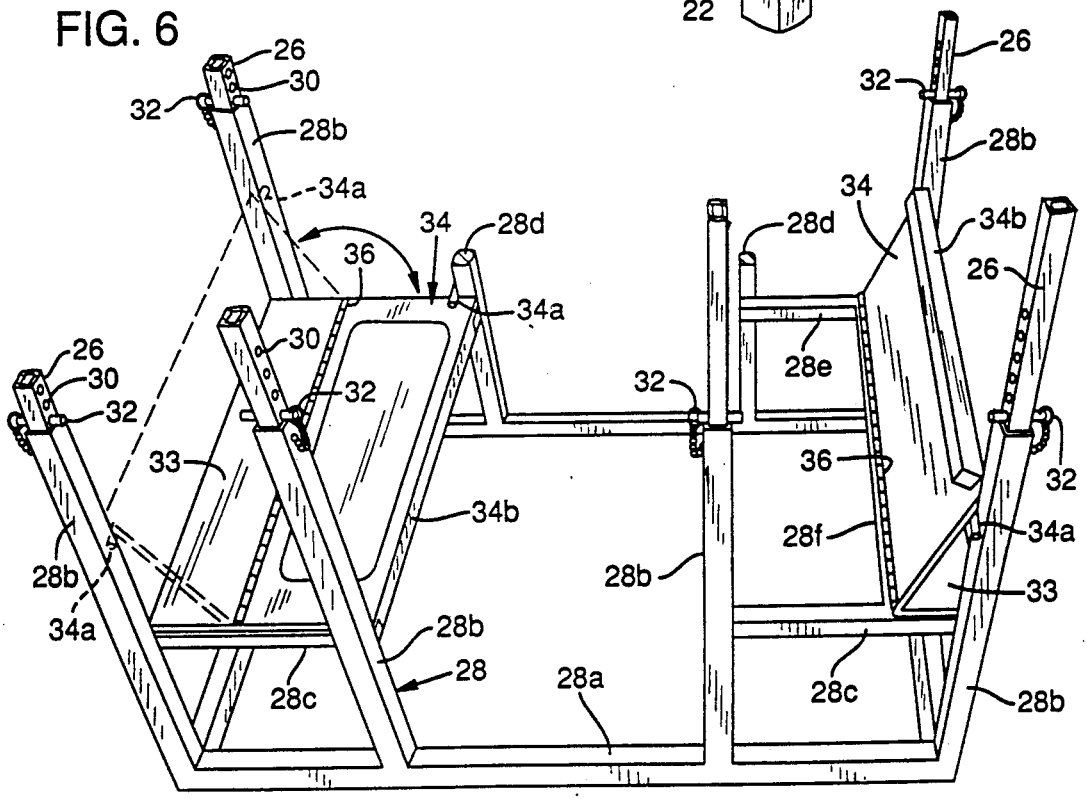
FIG. 6 is a partial perspective view illustrating portions of the upstanding frame of FIG. 1.

Forward and rear stop pins **34*a* are affixed to each of foot supports 34 to contact base 28 and retain foot supports 34 in a raised position. Forward and rear stop pins 34*a* contact corresponding outer uprights 28*b* to retain foot supports 34 in the raised position Supports 34 contact rails 28*e* and 28*c* in their lowered position. As shown in FIG. 6, right foot support 34 is in its lowered position, and left foot support 34 is in its raised position. Each of foot supports 34 include a support rail 34*b* affixed to its underside adjacent central opening 22** for additional rigidity while in its lowered position and supporting the weight of person P.

FIG. 5 illustrates a pivotal support structure for left load bearing element 18 and, unless otherwise indicated, represents a corresponding structure for right load bearing element 18. Right and left cross bar means each includes forward and rear slotted cross members 38. Such cross members are affixed to upper frame 24 in spaced parallel relation. Forward slotted cross member 38 lies in forward rail **24*a* and rear slotted cross member 38 lies on rear rail 24*b*. Each of slotted cross members 38 includes a series of upwardly opening slots 39. Each slot 39 in the forward cross member 38 is aligned with a corresponding slot 39** in rear cross member.

A pivot shaft 40 spans the distance between front and rear slotted cross members 38 and rests within selected corresponding slots 39 of the cross members 38. Pivot shaft 40 is laterally positionable with respect to central opening 22 by suitably placing pivot shaft 40 within corresponding slots of cross members 38. Two slotted lock bars 42 secure pivot shaft 40 within the selected slots 39 of cross members 38. The outer end of each lock bar 42 is pivoted to the outer end of its corresponding member 38 by a bolt 43. Each lock bar 42 includes downwardly opening slots 43, corresponding in position to slots 39 in cross members 38. Lock bars 42 pivot downwardly from an open position (left side of FIG. 5) to a closed position (right side of FIG. 5) adjacent the corresponding cross member 38 and contact upper frame 24. In the closed position, lock bars 42 and cross members 38 cooperate to provide closed apertures 45 (FIG. 5) for pivotally receiving corresponding ends of pivot shaft 40. Lock bars 42 and cross members 38 each include pin apertures 47 (FIG. 5) at the end closest to central opening 22. When lock bars 42 are in the closed position, apertures 47 of corresponding lock bars 42 and cross members 38 are aligned, allowing locking pins 44 inserted into apertures 47 to secure lock bars 42 in the closed position. Pivot shaft 40 can thus be captured in selected slots 39 between cross members 38 and lock bars 42. Bolt and washer assemblies 49 at the ends of shaft 40 prevent longitudinal movement of shaft 40. Shaft 40 is thereby securely mounted for pivotal movement.

Mounting bars 46 are affixed to pivot shaft 40 and extend generally upwardly from shaft 40 in spaced parallel relation. An upper pivot shaft 48 spans the distance between mounting bars 46 and is rotatably connected to their distal ends. Shaft 48 carries a mounting bracket 50. Load bearing element 18 attaches, e.g., by bolts (not shown), to bracket 50 and, by virtue of the pivotal mounting of shaft 40, pivots together with mounting bars 46 toward and away from central opening 22. Load bearing element 18 also pivots about shaft 48.

Figure 4:
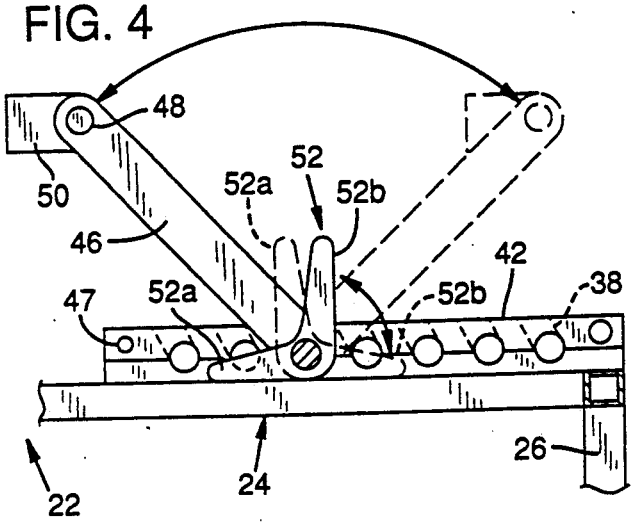
FIG. 4 is a partial front view illustrating pivotal movement of a mounting bar of the lumbar traction device of FIG. 1.

Wing stops 52 (FIGS. 4 and 5) attached to opposite ends of pivot shaft 40 extend above upper frame 24 to restrict pivotal motion of shafts 40 and element 18. Each wing stop 52 includes two legs. The first leg 52*a*, closest to opening 22, contacts upper frame 24 to define the extent to which load bearing element 18 pivots toward central opening 22. The second leg 52*b*, most distant from opening 22, determines the extent to which load bearing element 18 pivots away from central opening 22. As seen in FIG. 4, mounting bar 46 is pivoted toward central opening 22 and the first leg 52*a* of wing stop 52 is contacting upper frame 24. Mounting bar 46 and wing stop 52 also appear in phantom in FIG. 4 to illustrate the extent to which mounting bar 46 may pivot away from central opening 22 before the second leg 52*b* of wing stop 52 contacts upper frame 24. Limiting the extent to which mounting bars 46 pivot toward central opening 22 limits the extent to which load bearing elements 18 approach one another. If load bearing elements were not so restricted, instability of person P while in the traction position would result and excess pressure against torso 16 of person P could develop. Limiting the extent to which mounting bars 46 pivot away from opening 22 places load bearing elements in a convenient open position to allow person P to mount lumbar traction device 10.

Right and left load bearing elements 18 are molded and cushioned plastic shells which conform generally in shape to the right and left arms and to the torso of person P in the upright traction position. Load bearing elements 18 are adjusted laterally with respect to person P by positioning shaft 40 within selected slots of slotted cross members 38. Lateral positioning of shaft 40 is based generally on the width of torso 16 of person P. For a person having a broad torso, shafts 40 should be moved farther away from central opening 22. As will be explained in the overall operation of lumbar traction device 10, the lateral position of shafts 40 also determines to some extent the point at which traction is applied to the spine of person P.

Figure 3:
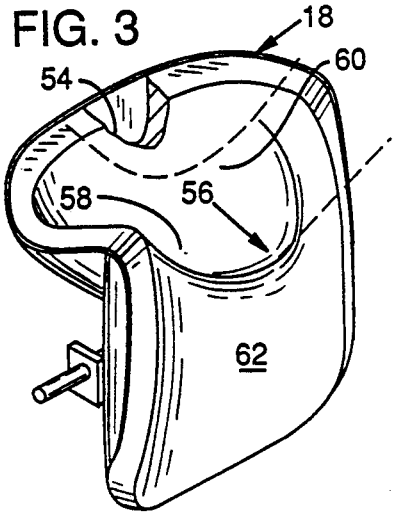
FIG. 3 is a perspective view of a load bearing element forming a portion of the lumbar traction device of FIG. 1.

In FIG. 3, right load bearing element 18 is shown in perspective. Each load bearing element 18 includes a padded lining 54 for contacting the arms and torso of the person receiving traction therapy. Pocket 56 receives the person's elbow, holds the person's arm in the upright traction position, and prevents load bearing element 18 from slipping upward on the person's torso. Upwardly facing surface 58 carries a substantial portion of the person's weight by contacting the downwardly facing surface of the person's forearm. Inwardly facing surface 60 restricts outward lateral movement of the person's arm by contacting the outwardly facing surface of the person's arm. Inwardly facing surface 62 contacts the person's torso and assists, primarily through friction, in supporting the weight of the person. Thus, load bearing elements 18 essentially form a two-piece padded upper body jacket for comfortably supporting person P in a natural upright position while receiving traction therapy.

Elements 18 have been constructed using a human model as a guide in forming the shell mold. In this manner, the elements 18 closely conform in shape to the arms and torso of the person. A thermo-plastic polycarbonate has been found to be a satisfactory material for constructing load bearing elements 18. If desired, such elements could be custom-molded for each user.

In overall operation, application of lumbar traction begins by first placing right and left foot supports 34 in their lowered or horizontal positions adjacent central opening 22. Person P enters the central opening and stands upon right and left foot supports 34. It may be necessary to adjust the vertical position of upper frames 24 in order to locate elements 18 below the arms of person P as person P stands upon supports 24. Right and left load bearing elements 18 are positioned laterally with respect to the person's torso by inserting pivot shaft 40 within slots 39 of cross members 38. Proper selection of slots 39 to position shafts 40 depends generally on the size of torso 16 and, as explained below, the amount of spinal traction desired. Lock bars 42 are pivoted to their closed positions and secured by pins 44 in order to retain pivot shaft 40. Load bearing elements 18 are pivoted inward toward central opening 22 such that person P may insert his or her right and left arms in load bearing elements 18, remove his or her feet from supports 34, and hang from elements 18 with legs straight and unsupported.

In this position, a substantial portion of person P's weight bears against surfaces 58 of load bearing elements 18 by way of forearms 14. The remaining weight of person P is carried by frictional contact with the surfaces 62 of elements 18 which bear inward against the right and left sides of the torso 16. Preferably, the lateral position of shafts 40 is such that at least one of load bearing elements 18 is not pivoted fully toward opening 22, i.e., the first leg 52*a* of the corresponding wing stops 52 is not contacting upper frame 24. While some inward pressure against the torso is experienced due to supporting the person's weight in this manner, this pressure is merely enough to create sufficient friction to prevent torso 16 from slipping in relation to surface 62. Most of the person's weight is carried by way of forearms 14. Also, load bearing elements 18 have a large surface area for distributing the pressure against the torso 16.

Further adjustment in the position of shafts 40 with respect to central opening 22 adjusts the area at which traction is applied to the spine of person P and therefore the amount of traction applied to the spine. Once shafts 40 are positioned generally in relation to the size of torso 16, and person P assumes the traction position as shown in FIGS. 1 and 2, a majority of the weight of person P is carried by way of the right and left arms and the remainder is carried below at the right and left sides of torso 16. Because most of person P's weight is carried at the upper portion of torso 16, i.e., at the shoulders where the right and left arms connect to torso 16, almost the full length of the spine of person P carries most of the weight of person P in tension. The desired substantially full-length spinal traction is thereby accomplished. However, by moving one or both of shafts 40, pressure exerted against the right and left sides of torso 16 is varied, and a corresponding portion of person P's weight carried by the right and left arms is varied. Such variability provides the advantage of adjustability for maximum user comfort. Also, such variability provides adjustability of traction applied to the spine. For example, with more weight being carried at a lower point on torso 16, the upper spine of person P carries less weight in tension and a lesser amount of traction is thus applied to the spine. Also, where most of the weight of person P is supported by torso support surfaces 62 rather than arm support surfaces 58 of the load bearing elements, most of the weight-induced traction is applied only to the lower portion of the spine below the torso support surfaces. Accordingly, lumbar traction device 10 is adaptable for user comfort and is capable of providing varying amounts of spinal traction therapy to either substantially the full length or to the lower portion of the spine depending on the positioning of shafts 40.

Load bearing elements 18 receive the person's arms while bent naturally forward in the upright traction position and restrict outward lateral movement of the arms. Very little effort is required to maintain the upright traction position. Person P is able to relax while in the lumbar traction position and receive traction therapy comfortably for long periods of time.

Once positioned in the upright traction position and supported by elements 18, person P may perform exercises. With right and left foot supports 34 pivoted upwardly away from opening 22, a greater open area is available. To exercise or stretch the back and legs, person P swings the legs side-to-side or forward from the waist. Individual vertebrae are desirably flexed relative to one another during traction therapy.

Thus, an improved traction therapy apparatus has been shown. Lumbar traction device 10 provides spinal traction therapy without requiring person P to exert effort to maintain the traction position. Lumbar traction device 10 comfortably supports person P enabling use of traction device 10 for extended periods.

While a preferred embodiment of the present invention has been shown and described, it will be apparent to those skilled in the art that many changes and modifications may be made without departing from the invention in its broader aspects. The appended claims are therefore intended to cover all such changes and modifications as fall within the true spirit and scope of the invention.

What is claimed is:

1. A traction device for supporting the weight of a person in an upright traction position, the person having a torso and right and left arms, each including a forearm and an upper arm, said traction device comprising:

load bearing means for receiving the right and left arms and supporting at least a substantial portion of the weight of the person by way of the right and left arms, said load bearing means including means for restricting outward lateral movement of the right and left arms relative to the torso;

frame means for supporting said load bearing means adjacent the right and left arms of the person when the person is in the upright traction position; and said load bearing means being pivotally mounted on said frame means for pivoting movement about a generally horizontal pivot axis extending in the for and aft direction of said frame means, said horizontal pivot axis located laterally outwardly of the body position of the person supported in an upright traction position by the load bearing means, each pivot axis being laterally adjustable toward and away from the body position.

2. A traction device according to claim 1 wherein said load bearing means contacts a substantial length of the right and left forearms to receive at least a substantial portion of the weight of the person by way of the right and left forearms.

3. A traction device according to claim 1 wherein said load bearing means comprises shell means conforming in shape to portions of the torso and right and left arms of the person when the right and left arms of the person lay along the torso in a naturally bent position.

4. A traction device according to claim 1 wherein the load bearing means supports the person in an upright traction position with the right and left upper arms along the torso with the right and left forearms bent naturally forward at an acute angle relative to the right and left upper arms, respectively, to face downwardly first surface portions of said right and left forearms and face laterally outward second surface portions of said right and left forearms, and wherein said load bearing means includes upwardly facing first surface means contacting the first surface portions of the right and left forearms for supporting weight of the person thereat, and includes laterally inward facing second surface means contacting the second surface portions of the right and left forearms for restricting outward lateral movement of the right and left forearms relative to the torso, the first surface means being positioned above at least the major vertical extent of said second surface means when the person is in an upright traction position.

5. A traction device for supporting the weight of a person in an upright traction position wherein the right and left upper arm lay along the torso with the right and left forearms bent naturally forward at an acute angle relative to the right and left upper arms, respectively, said traction device comprising:

right support means conforming in shape to the right arm and torso of the person when the person is in the upright traction position, said right support means being adapted to support at least a substantial portion of the weight of the person by contacting the right forearm, said right support means being adapted to restrict outward lateral movement of the right arm relative to the torso;

left support means conforming in shape to the left arm and torso of the person when the person is in the upright traction position, said left support means being adapted to support at least a substantial portion of the weight of the person by contacting the left forearm, said left support means being adapted to restrict outward lateral movement of the left arm relative to the torso;

said right and left support means each including an upwardly directed forearm support surface portion and a torso contact surface portion directed inwardly toward the torso of a person supported in an upright traction position, with the torso contact surface portion extending from an upper terminus substantially no higher than the uppermost level of the forearm support surface portion downwardly a substantial distance below the forearm support surface portion; and frame means for positioning the right support means adjacent the right arm of the person and for positioning the left support means adjacent the left arm of the person when the person is in the upright traction position.

6. A traction device according to claim 5 wherein said right and left support means include forearm engaging portions for supporting at least a portion of the weight of the person and torso engaging portions for carrying a portion of the weight of the person by frictionally engaging respective sides of the torso of the person, said torso engaging portion being positioned below said forearm engaging portions.

7. A traction device according to claim 6 further comprising means for adjusting the amount of weight carried at the arms relative to the amount of weight carried at the torso of the person for adjusting the amount of traction applied to the spine of the person.

8. A traction device according to claim 7 wherein said adjusting means comprises means for lateral positioning of said right and left support means with respect to the person when in the upright traction position.

9. A traction device according to claim 5 wherein said frame means includes means for adjusting the lateral position of at least one of the right support means and left support means relative to the torso of the person when the person is in the upright traction position for adjusting the amount of weight carried at the arms relative to the amount of weight carried at the torso.

10. A traction device according to claim 5 wherein said frame means is vertically adjustable for vertical positioning of said right and left support means to accommodate persons of different height.

11. A traction device for supporting the weight of a person in an upright traction position wherein the right and left upper arms lay along the torso with the right and left forearms bent naturally forward at an acute angle relative to the right and left upper arms, respectively, said traction device comprising:

right support means conforming in shape to the right arm and torso of the person when the person is in the upright traction position, said right support means being adapted to support at least a substantial portion of the weight of the person by contacting the right forearm, said right support means being adapted to restrict outward lateral movement of the right arm relative to the torso;

left support means conforming in shape to the left arm and torso of the person when the person is in the upright traction position, said left support means being adapted to support at least a substantial portion of the weight of the person by contacting the left forearm, said left support means being adapted to restrict outward lateral movement of the left arm relative to the torso; and frame means for positioning the right support means adjacent the right arm of the person and for positioning the left support means adjacent the left arm of the person when the person is in the upright traction position, said frame means including means for pivotal mounting of said right and left support means, said pivotal mounting means comprising:

a first right pivot shaft pivotally coupled to said frame means;

right mounting bar means affixed to said first right pivot shaft and extending generally upwardly therefrom;

a second right pivot shaft pivotally coupled a distal portion of said right mounting bar means;

right bracket means connecting said second right pivot shaft to said right support means whereby said right support means is pivotable about said first and second right pivot shafts;

a first left pivot shaft pivotally coupled to said frame means;

left mounting bar means affixed to said first left pivot shaft and extending generally upwardly therefrom;

a second left pivot shaft pivotally coupled a distal portion of said left mounting bar means; and left bracket means connecting said second left pivot shaft to said left support means whereby said left support means is pivotable about said first and second left pivot shafts.

12. A traction device according to claim 11 wherein said frame means further comprises means for lateral positioning of said first right and said first left pivot shafts relative to the person when in the upright traction position.

13. A traction device according to claim 12 wherein said lateral positioning means comprises:

right cross bar means for pivotally supporting said first right pivot shaft, said right cross bar means including a plurality of upwardly facing slots for receiving said first right pivot shaft; and left cross bar means for pivotally supporting said first left pivot shaft, said left cross bar means including a plurality of upwardly facing slots for receiving said first left pivot shaft.

14. A method of applying lumbar traction to person having a torso and right and left arms each including a forearm and an upper arm, the method comprising the steps:

positioning the right and left upper arms along the torso with the right and left forearms bent naturally forward relative to the right and left upper arms, respectively, first surface portions of the right and left forearms being substantially downwardly facing, second surface portions of said right and left forearms being substantially outwardly facing relative to the torso;

supporting a substantial portion of the weight of the person with a load supporting surface contacting the first surface portions of the right and left forearms; and restricting outward lateral movement of the right and left arms relative to the torso with a restricting surface contacting the second surface portions of the right and left forearms.

15. A traction device for supporting the weight of a person in an upright traction position wherein the right and left upper arms of the person lay along the torso with the right and left forearms bent naturally forward at an acute angle relative to the right and left upper arms, respectively, said traction device comprising:

a freestanding open frame defining a central upright opening for receiving the person when in the traction position, said frame including a horizontal upper frame portion and telescopically adjustable vertical supports for adjusting the vertical position of said upper frame portion;

a first foot support shelf positioned on a first side of the central opening below said upper frame portion;

a first hinge coupling said first foot support shelf to said frame along an edge most distant from said central opening, said first foot support shelf being positionable horizontally adjacent said central opening and upwardly pivotable away from said central opening;

a second foot support shelf positioned on a second side of the central opening opposite the first side of the central opening and below said upper frame portion;

a second hinge coupling said second foot support shelf to said frame along an edge most distant from said central opening, said second foot support shelf being positionable horizontally adjacent said central opening and upwardly pivotable away from said central opening;

a first pair of upward facing slotted cross members mounted horizontally upon said upper frame portion, said first pair of slotted cross members being in spaced parallel relation and positioned above said first foot support shelf, each one of said first pair of slotted cross members having a first end adjacent said central opening and extending outward from said central opening with a second end most distant from said central opening, a first one of said first pair of cross members being adjacent a forward portion of said central opening, a second one of said first pair of cross members being adjacent a rearward portion of said central opening;

a second pair of upward facing slotted cross members mounted horizontally upon said upper frame portion, in co-planar relation to said first pair of slotted cross members said second pair of slotted cross members being in spaced parallel relation and positioned above said second foot support shelf, each one of said second pair of slotted cross members having a first end adjacent said central opening and extending outward from said central opening with a second end most distant from said central opening, a first one of said second pair of cross members being adjacent a forward portion of said central opening and in alignment with the first one of said first pair of cross members, a second one of said second pair of cross members being adjacent a rearward portion of said central opening and in alignment with said second one of said first pair of cross members;

a first pivot shaft spanning said first pair of slotted cross members, said first pivot shaft having a first end adapted for insertion in a selected slot of the first one of said first pair of cross members and a second end adapted for insertion in a selected slot of the second one of said first pair of cross members, said first pair of cross members pivotally supporting said first pivot shaft;

a second pivot shaft spanning said second pair of slotted cross members, said second pivot shaft having a first end adapted for insertion in a selected slot of the first one of said second pair of cross members and a second end adapted for insertion in a selected slot of the second one of said second pair of cross members, said second pair of cross members pivotally supporting said second pivot shaft;

a first pair of downward facing slotted lock bars, each one of said first pair of downward facing slotted lock bars pivotally coupled to the second end of a corresponding one of said first pair of upward facing slotted cross members and having slots corresponding to slots in said first pair of upward facing cross members whereby said first pair of downward facing slotted lock bars each pivot to a closed position adjacent the corresponding one of the first pair of upward facing cross members to capture said first pivot shaft in the selected slots;

pin means for securing said first pair of downward facing slotted lock bar in its closed position;

a second pair of downward facing slotted lock bars, each one of said second pair of downward facing slotted lock bars pivotally coupled to the second end of a corresponding one of said second pair of upward facing slotted cross members and having slots corresponding to slots in said second pair of upward facing cross members whereby said second pair of downward facing slotted lock bars each pivot to a closed position adjacent the corresponding one of the second pair of upward facing cross members to capture said second pivot shaft in the selected slots;

pin means for securing said second pair of downward facing slotted lock bars in its closed position;

a first mounting bar pair, each one of said first mounting bar pair connected to said first pivot shaft and extending upward therefrom in spaced parallel relation;

a second mounting bar pair, each one of said second mounting bar pair connected to said second pivot shaft and extending upward therefrom in spaced parallel relation;

a first wing stop pair, each one of said first wing stop pair being connected to respective ends of said first pivot shaft and positioned to contact said upper frame portion and provide two stable positions for said first pivot shaft;

a second wing stop pair, each one of said second wing stop pair being connected to respective ends of said second pivot shaft and positioned to contact said upper frame portion and provide two stable positions for said second pivot shaft;

a third pivot shaft connected to said first mounting bar pair;

a fourth pivot shaft connected to said second mounting bar pair;

a first mounting bracket pivotally coupled to said third pivot shaft;

a second mounting bracket pivotally coupled to said fourth pivot shaft;

a first support shell conforming substantially in shape to the right arm and torso of the person when the person is in the upright traction position; and a second support shell conforming substantially in shape to the left arm and torso of the person when the person is in the upright traction position.

* * * * *